United States Patent [19]

Van Den Eynde

[11] Patent Number: 5,063,665

[45] Date of Patent: Nov. 12, 1991

[54] PROCEDURE FOR THE CONTINUOUS MANUFACTURE OF WALL ELEMENTS

[75] Inventor: J. Van Den Eynde, Lier, Belgium

[73] Assignee: Plafittco, naamloze vennootschap, Lier, Belgium

[21] Appl. No.: 536,510

[22] Filed: Jun. 12, 1990

[30] Foreign Application Priority Data

Jun. 16, 1989 [BE] Belgium ..... 8900654

[51] Int. Cl.[5] ..... B23P 17/00

[52] U.S. Cl. ..... 29/897.312; 29/897.31; 29/897.32

[58] Field of Search ..... 29/897.3, 897.31, 897.312, 29/897.32; 52/741, 577, 94, 90, 221, 220, 309.11

[56] References Cited

U.S. PATENT DOCUMENTS

| | | | |
|---|---|---|---|
| 2,262,827 | 11/1941 | Wilson, Jr. et al. | 52/741 X |
| 2,652,713 | 9/1953 | Senglar | 52/577 X |
| 3,236,014 | 2/1966 | Edgar | 52/94 X |
| 3,378,964 | 4/1968 | Erickson | 52/741 X |
| 3,462,897 | 8/1969 | Weinrott | 52/90 X |
| 3,500,597 | 3/1970 | McKenzie | 52/94 X |
| 3,665,662 | 5/1972 | Timbrook et al. | 52/221 X |
| 3,699,622 | 10/1972 | Frydenberg | 29/897.31 |
| 4,327,535 | 5/1982 | Governale | 52/309.11 |
| 4,330,921 | 5/1982 | White, Jr. | 29/897.32 X |

FOREIGN PATENT DOCUMENTS

| | | |
|---|---|---|
| 1784391 | 8/1971 | Fed. Rep. of Germany . |
| 2140312 | 3/1972 | Fed. Rep. of Germany . |
| 388580 | 6/1965 | Switzerland . |
| 1328391 | 8/1973 | United Kingdom . |

*Primary Examiner*—Timothy V. Eley
*Assistant Examiner*—C. Richard Martin
*Attorney, Agent, or Firm*—Foley & Lardner

[57] ABSTRACT

Procedure for the continuous manufacture of wall elements, characterized in that the different walls are effected continuously on a suitable transport system whereby these walls are assembled in vertical position on this transport system. The procedure includes at least the step of placing upper and lower beams; the connecting together of the extremities of these upper and lower beams placed behind each other without taking into consideration the length of the walls to be effected with regard to the length of these upper and lower beams; the installation of the windows and doors; the placing of the vertical posts; the placing of a first covering; the installation of electricity wires, sanitary pipes and utility pipes; the installation of insulating material; the installation of the second covering; the sawing out of the coverings at the location of the doors and/or windows; the sawing off to measure of the different walls.

5 Claims, 1 Drawing Sheet

PROCEDURE FOR THE CONTINUOUS MANUFACTURE OF WALL ELEMENTS

BACKGROUND OF THE INVENTION

1. Field of the Invention

This invention relates to a procedure for the continuous manufacture of wall elements as well as to installations which utilize such procedure.

More especially the present invention relates to an aforementioned procedure for the continuous manufacture of both inner walls and outer walls for houses, whereby these walls are in principle formed by a wooden frame that is provided with windows, doors and such, and that is entirely finished including insulation, electricity wires and other utility pipes, as well as covering. In other words the invention relates to walls which are intended for the effectuation of so-called prefab houses.

2. Description of the Related Art

It is known that such aforementioned walls are usually constructed horizontally, in other words, are placed on tables support on horizontal girders and posts which may or not be movable and which are mutually connected between these girders and posts, the doors, windows, pipes and such are mounted after which the unit is sealed by a suitable covering on the top, and subsequently the thus partially formed wall is turned over 180 degrees in order to install insulating material and a second covering to the second side.

A first disadvantage of this known procedure is to be seen in the fact that relatively much space is occupied by the production of such walls, since the walls are laid out horizontally, and since such production usually occurs in various steps so that the necessary surface area can become very large if it is known that such walls or more a height of almost 3 meters or more and a width which can go to 12 meters and more.

Another disadvantage is that such a large surface area will not always be employed efficiently, when, on such tables or made for surfaces of 3 to 12 meters and more, a small wall must be manufactured, for example a wall of 3 meters high and a width which is notably smaller than 12 meters, for example a width of 1 meter, which regularly occurs.

Yet another disadvantage of this known procedure is to be seen in the fact that the manufacture of such horizontal walls is relatively difficult especially at the location of the half height or center of the wall, since for this purpose one must always bend over these tables.

Still another disadvantage of the known procedure is that such walls must be produced in two steps because, when such a wall is completely produced on one side, it must be turned 180 degrees in order to finish the second side.

The disadvantage ensuing from this is that for the turning of such a wall again requires a very large inverting table.

SUMMARY OF THE INVENTION

The object of the invention is a procedure which totally excludes the aforementioned and other disadvantages and which for this purpose consists of at least the following steps. The placing of upper and lower beams; the connecting together of the extremities of these upper and lower beams placed behind each other without taking into consideration the length of the walls to be effected with regard to the length of these upper and lower beams; the installation of the windows and doors; the placing of the vertical posts; the placing of a first covering; the installation of electricity wires, sanitary pipes and utility pipes; the installation of insulating material; the installation of the second covering; the sawing out of the coverings at the location of the doors and/or windows; the sawing off to measure of the different walls.

BRIEF DESCRIPTION OF THE DRAWING

In order to show better the characteristics according to the present invention, as examples without any restrictive character, in FIG. 1, a block diagram is given of this procedure, while in FIGS. 2 and 3, a schematic representation is shown hereafter, respectively for the production of inner walls and for the production of outer walls.

DETAILED DESCRIPTION OF THE PREFERRED EMBODIMENTS

Figure 1:
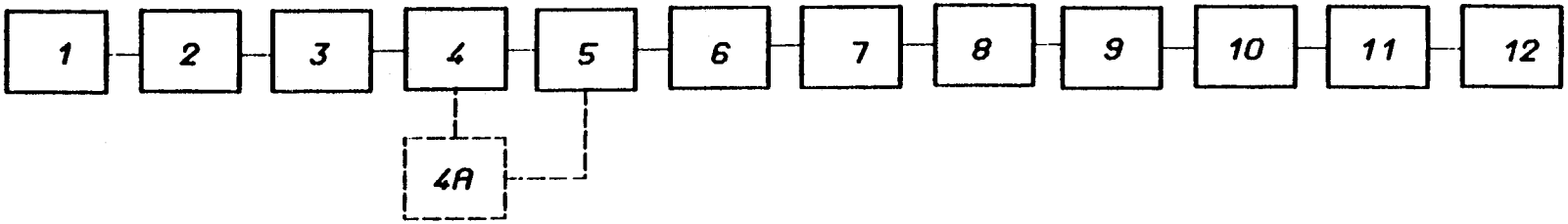

In FIG. 1 a block diagram is shown of the procedure according to the invention in which the different phases for the manufacture of a wall according to the invention are given.

The wall is, according to the invention, manufactured vertically on the basis of an automatic shifting up system, whereby the component elements of various walls are brought toward each other without interruption and follow each other in order. Finally at the end of the production line, as it were, the desired wall assemblies at the desired wall lengths are separated from each other.

In the aforementioned block diagram the twelve successive phases are shown by 1 through 12 which in principle are utilized with the production of walls according to the invention.

Theses phases are:

1. The placing of wooden girders at a suitable distance above each other which form the lower beam and upper beam of the walls to be constructed;

2. The attachment to each other of the extremities of the lower beams and upper beams following each other in order to form one single lower beam, and one single upper beam, respectively which will move forward over the entire production line, this connection to each other can occur by joining together the extremities of the beams following each other, by means of clamps or the like without taking into consideration the length of the walls to be constructed with regard to the length of these upper and lower beams;

3. The installation of windows and doors at the suitable heights;

4 . The installation of the vertical posts which at the same time will hold fast the aforementioned windows and doors;

5. The installation of a first covering to one side, for example plasterboards;

6. The installation of the electricity wires, sanitary pipes, and other utility pipes;

7. The installation of the insulating material;

8. The placing of a second covering onto the second side of the wall, whereby this second covering, depending on whether an inner wall of an outer wall will be formed, for example, by respectively placing plasterboards and multi-ply boards or the like;

9. The sawing out of the first and second coverings, on the one hand and at the locations of the doors and windows;

10. The sawing to measure, i.e. the desired lengths of the different walls by the sawing through the consecutive lower beams and upper beams;

11. The storage of the sawn off walls in a buffer zone;

12. The placing of the walls on a loading platform in order to bring them to a loading quay for example.

In FIG. 1 another possible additional phase is indicated, namely phase 4A which can consist in that between the phases 4 and 5, a phase is inserted in construction of outer walls which, consists in the placing, prior to the installation of a covering, of a so-called vapor screen.

In this manner a vertical assembly possibility for walls in a continuous system is obtained. In this procedure the different walls are constructed and brought together without interruption such that at the same time, both sides of the wall can be worked on such that only a small space is necessary in order to effect such production. Thus, the necessary investment for space, and for the actual transport system and such can remain very small, particularity because and doors are installed simply during the production process, and subsequently the complete wall is covered in order to saw away the covering later at the location of such doors or windows.

It has indeed appeared that such a procedure is very simple and effective without the possible production of more waste in any manner.

Figure 2:
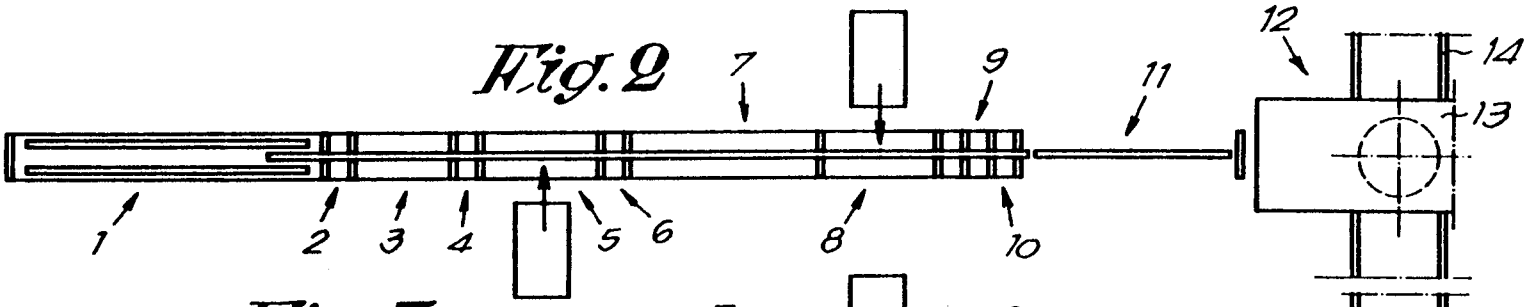

In FIG. 2 a representation is drawn up of the block diagram according to FIG. 1 for the production of inner walls. The various phases are indicated by the same references as in FIG. 1 so that on this subject no further explanation is required.

Figure 3:
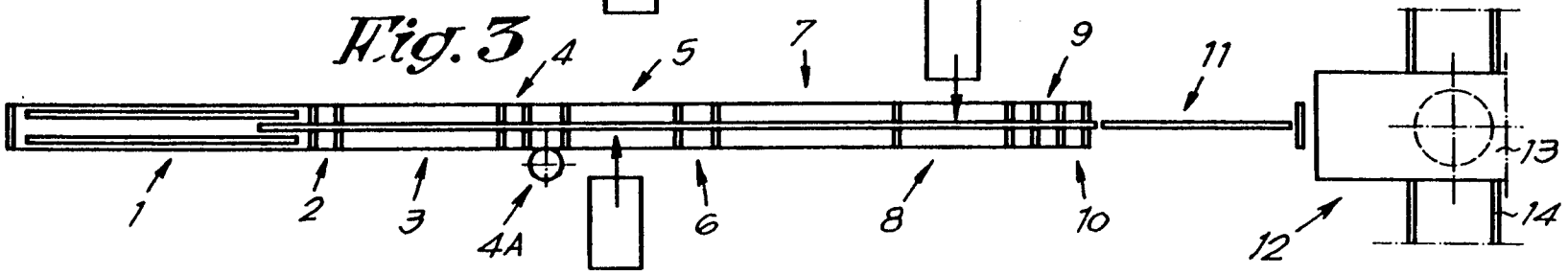

In a similar manner a representation is shown in FIG. 3 for the production of outer walls whereby likewise the aforementioned phases are indicated with the same references.

It is clear that the present invention is in no way limited to the aforementioned phases but could possibly be supplemented by certain intermediate steps, for example for the installation of certain intermediate layers, several coverings or the like.

The production as referred to above, will preferably occur on a perpetual transport system that is not shown on the drawings since such transport systems are known generally and can be effected in all possible forms, while for the loading platform 12, use will preferably be made of a table 13 which, after a wall 11 is installed thereon, can be rotated 90 degrees in order to move this table along a suitable transport system 14 toward a loading guay or the like.

It is clear that the present invention relates both to the aforementioned procedure and to the installations or devices which utilize such procedure.

I claim:

1. A process for continuously assembling walls while they are being conveyed in a vertical position through a transport system, comprising the steps of:

(a) placing upper beams of said walls vertically above lower beams thereof;

(b) connecting the upper beams end-to-end in order to form one single continuous upper beam and also connecting the lower beams end-to-end in order to form one single continuous lower beam, said connections being made without taking into consideration the length of the walls to be constructed;

(c) installing at least one of windows and doors in said walls;

(d) placing vertical posts into said walls;

(e) placing a first covering on one side of said walls; then (f) installing at least one of electricity wires, sanitary pipes, and utility pipes in said walls;

(g) installing insulation materials in said walls;

(h) placing a second covering on another side of said walls;

(i) sawing locations of windows and doors out of said first and second coverings; and (j) sawing each of said walls to a predetermined length.

2. The process according to claim 1, further comprising the step of installing a vapor screen on at least one side of said walls after said vertical posts are installed therein.

3. The process according to claim 1, further comprising the step of storing said walls in a buffer zone after they are sawn to a predetermined length.

4. The process of claim 3, further comprising the step of removing said walls from said buffer zone and placing them on a loading platform formed by a table which is rotatable through 90 degrees so that said walls can be moved along a rail system to a loading location.

5. A process for continuously assembling walls while they are being conveyed in a vertical position through a transport system, comprising the steps of:

(a) placing upper beams of said walls vertically above lower beams thereof;

(b) connecting the upper beams end-to-end in order to form one single continuous upper beam and also connecting the lower beams end-to-end in order to form one single continuous lower beam, said connections being made without taking into consideration the length of the walls to be constructed;

(c) installing at least one opening into said walls;

(d) placing vertical posts into said walls;

(e) placing a first covering on one side of said walls; then (f) installing at least one utility element in said walls;

(g) installing insulation materials in said walls;

(h) placing a second covering on another side of said walls;

(i) sawing locations of windows and doors out of said first and second coverings; and (j) sawing each of said walls to a predetermined length.

* * * * *